US010017292B1

(12) United States Patent
Anderson et al.

(10) Patent No.: US 10,017,292 B1
(45) Date of Patent: Jul. 10, 2018

(54) CONTAINER WITH INTEGRAL INTERLOCKING CLIP(S)

(71) Applicant: INTERNATIONAL BUSINESS MACHINES CORPORATION, Armonk, NY (US)

(72) Inventors: Ryan R. Anderson, Rochester, MN (US); William J. O. Green, Cary, NC (US); Tate T. Harnack, Brodhead, WI (US); Justin T. Melby, Rochester, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/402,426

(22) Filed: Jan. 10, 2017

(51) Int. Cl.
*B65D 5/42* (2006.01)
*B65D 5/64* (2006.01)

(52) U.S. Cl.
CPC ..... *B65D 5/4283* (2013.01); *B65D 5/427* (2013.01); *B65D 5/64* (2013.01); *B65D 2571/00277* (2013.01)

(58) Field of Classification Search
CPC ..... B65D 5/427; B65D 5/4283; B65D 5/64; B65D 2571/00277; B65D 2571/0016; B65D 2571/00172
USPC ..... 229/120.01, 182.2, 103.2, 185, 149
See application file for complete search history.

(56) References Cited

U.S. PATENT DOCUMENTS 1,174,605 A 3/1916 Cook
1,765,964 A 6/1930 Berton
1,776,628 A 9/1930 Verville
2,120,470 A * 6/1938 Patterson ..... B65D 5/4279 206/140
3,069,065 A 12/1962 Bebout et al.
3,746,245 A 7/1973 Oblesbee
4,093,116 A * 6/1978 Watkins ..... 206/147
4,243,143 A * 1/1981 Muller ..... B65B 11/105 206/429
4,386,729 A * 6/1983 Schmidt ..... B65D 5/10 229/109

(Continued)

FOREIGN PATENT DOCUMENTS

WO WO/1995019295 A1 7/1995

*Primary Examiner* — Justin Larson

(74) *Attorney, Agent, or Firm* — Tihon Poltavets, Esq.; Kevin P. Radigan, Esq.; Heslin Rothenberg Farley & Mesiti P.C.

(57) ABSTRACT

An interlocking clip, a container incorporating the interlocking clip, and methods of fabricating of the interlocking clip and container are provided. The interlocking clip is formed integral with first and second container sections for fastening the container sections together, and includes a tab-receiving aperture and a locking tab. The tab-receiving aperture is formed through a container wall of the first container section, and the locking tab is formed from, and integral with, a container wall of the second container section. The locking tab is bendable to interlock with the tab-receiving aperture, and includes bendable extensions on opposite sides of the locking tab. The bendable extensions include wall-receiving grooves to receive the container wall on opposite sides of the tab-receiving aperture in the first container section. In operation, the locking tab inserts into the tab-receiving aperture to interlock the first and second container sections together.

20 Claims, 12 Drawing Sheets

(56) References Cited

U.S. PATENT DOCUMENTS 4,491,223 A * 1/1985 Oliff ..... B65D 71/16 206/140
4,516,718 A * 5/1985 Forbes, Jr. ..... B65D 5/68 229/146
4,607,786 A 8/1986 Weaver
4,655,388 A * 4/1987 Fleming ..... G11B 33/0416 206/126
4,685,566 A * 8/1987 Wilson ..... B65D 71/36 206/427
5,069,335 A * 12/1991 Beales ..... B65D 5/427 206/144
5,145,062 A * 9/1992 Crispi ..... A47K 10/185 206/233
5,145,110 A 9/1992 Terpstra
5,398,870 A * 3/1995 Bienaime ..... B65D 71/12 229/103.2
5,522,538 A 6/1996 Gray
5,524,760 A 6/1996 Funk
5,975,286 A * 11/1999 Oliff ..... B65D 71/06 206/140
6,230,969 B1 * 5/2001 Spransy ..... B65D 81/3205 220/23.4
6,315,123 B1 * 11/2001 Ikeda ..... B65D 71/12 206/434
6,357,652 B1 * 3/2002 Evans ..... B65D 5/427 220/23.4
6,926,195 B1 * 8/2005 Rhyne ..... B65D 5/4279 229/149
8,567,839 B2 * 10/2013 Kalus ..... B60N 2/466 296/39.1
9,522,761 B2 * 12/2016 Baker ..... B65D 5/0015
9,694,934 B2 * 7/2017 Olds ..... B65D 11/1833
9,776,758 B2 * 10/2017 Rentzel ..... B65D 5/427
9,797,424 B2 * 10/2017 Vandenberghe ..... B31F 5/027
2016/0194111 A1 * 7/2016 Sharon ..... B65D 21/0204 229/108

* cited by examiner

CONTAINER WITH INTEGRAL INTERLOCKING CLIP(S)

BACKGROUND

Packaging design's primary function is protection and containment, but packaging is also a contributor to brand perception and functionality. For instance, in an electronics environment, improved brand perception may be achieved by reducing the amount of packaging required to ship an electronic system, such as an electronics rack, IT rack, compute rack, server rack, etc., which are herein referred to as an electronics rack. In addition, manufacturing environments, including at the packaging phase, continually strive towards optimal efficiency.

Conventionally, two or more separate container pieces may be used to cover an electronics rack for shipping. These pieces may include, for instance, a container sleeve wrapping around the rack, and a top cap. Having two separate pieces for each size rack increases inventory, and creates a greater chance for packaging assembly mistakes. Additionally, the top cap may require multiple people to assemble, and once assembled, the top cap conventionally overhangs the container sleeve, and may therefore be subject to damage in shipping.

Additionally, with current packaging, plastic clips may be employed to fasten together container sections to form the container sleeve about, for instance, the electronics rack. This is typically a manual process requiring, for instance, hole-alignment in the different container sections, as well as the purchase and assembly of the plastic clips. This results in wasted time gathering clips, aligning holes perfectly, and assembling the clips. Further, the use of separate plastic clips is not environmentally friendly.

SUMMARY

Shortcomings of the prior art are overcome and additional advantages are provided through, in one or more aspects, the provision of a fastener which includes an interlocking clip formed integral with one container section and another container section for fastening the container sections together, where the container sections are overlapping container sections. The interlocking clip includes a tab-receiving aperture through a container wall of the one container section, and a locking tab formed from, and integral with, a container wall of the another container section, the locking tab being bendable to interlock with the tab-receiving aperture in the one container section. The locking tab includes bendable extensions on opposite sides of the locking tab. The bendable extensions include wall-receiving grooves to receive the container wall on opposite sides of the tab-receiving aperture in the one container section when the locking tab is operatively inserted into the tab-receiving aperture to interlock the container sections together.

In another aspect, a container is provided which includes a first container section, a second container section, and multiple interlocking clips. The multiple interlocking clips are formed integral with the first and second container sections for fastening the first and second container sections together, and the first and second container sections are overlapping container sections. At least one interlocking clip of the multiple interlocking clips includes a tab-receiving aperture through a container wall of one of the first and second container sections, and a locking tab formed from, and integral with, a container wall of the other of the first and second container sections, where the locking tab is bendable to interlock with the tab-receiving aperture. The locking tab includes bendable extensions on opposite sides of the locking tab. The bendable extensions include wall-receiving grooves to receive the container wall on opposite sides of the tab-receiving aperture when the locking tab is operatively inserted into the tab-receiving aperture to interlock the container sections together.

In a further aspect, a method is provided which includes forming an interlocking clip integral with one container section and another container section for fastening the container sections together. The one container section and the another container section are to be overlapping container sections, and the forming includes: providing a tab-receiving aperture through a container wall of the one container section; and providing a locking tab formed from, and integral with, a container wall of the another container section. The locking tab is bendable to interlock with the tab-receiving aperture of the one container section, and the locking tab includes bendable extensions on opposite sides of the locking tab. The bendable extensions include wall-receiving grooves to receive the container wall on opposite sides of the tab-receiving aperture in the one container section when the locking tab is operatively inserted into the tab-receiving aperture to interlock the container sections together.

Additional features and advantages are realized through the techniques described herein. Other embodiments and aspects are described in detail herein and are considered a part of the claimed aspects.

BRIEF DESCRIPTION OF THE DRAWINGS

One or more aspects are particularly pointed out and distinctly claimed as examples in the claims at the conclusion of the specification. The foregoing and objects, features, and advantages of one or more aspects are apparent from the following detailed description taken in conjunction with the accompanying drawings in which:

DETAILED DESCRIPTION

Figure 1:
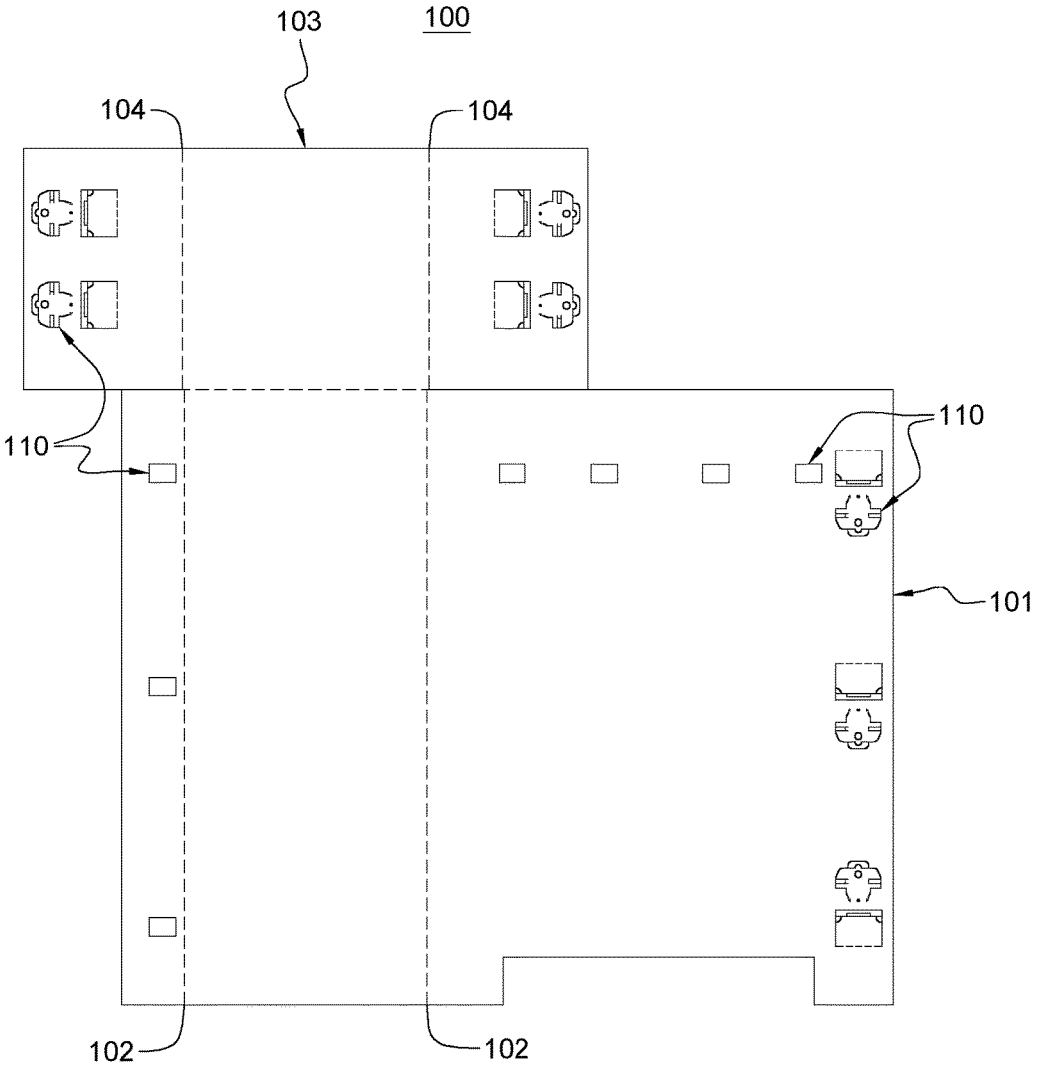
FIG. 1 is a plan view of one embodiment of a container section, such as a corrugated fiberboard cutout section, with interlocking clip cutouts, in accordance with one or more aspects of the present invention.

As noted, manufacturing environments typically strive towards optimal efficiency and reduced costs, while also striving to become more environmentally friendly. As one aspect of this, manufacturing continually seeks to enhance product packaging, so as to obtain greater efficiency, while providing the needed package strength and integrity, but with reduced cost and less environmental impact.

Currently two or more separate container pieces may be used to cover an electronics rack for shipping. These pieces may include a container sleeve that wraps around the rack, and a top cap which attaches over the sleeve. The container sleeve may be assembled from different cutout pieces using multiple plastic clips. The use of such clips conventionally requires aligning holes in two pieces of packaging, inserting a plastic clip, and locking the clip in place. Further, plastic clips are not inherently environmentally friendly since they are typically made of non-biodegradable materials, such as polypropylene. In addition, hinges in today's plastic clips for packaging may be extremely thin, which may lead to breakage issues. Further, in many container designs, staples may alternatively or additionally be extensively used in order to secure container pieces together, for instance, to form a sleeve to receive the product. The use of staples requires additional assembly time and process steps during the packaging phase.

Disclosed herein in one more aspects therefore is an interlocking clip die-cut from, for instance, one or more container sections, and methods of fabrication thereof, along with containers employing the interlocking clip. The interlocking clip disclosed provides numerous advantages, including, for instance: an increased freedom of motion without sacrificing container integrity; preventing infiltration of dust and debris by covering openings; allowing for relaxed dimensional tolerance to assemble the container; requiring no additional tooling to produce since the interlocking clip may be formed integral with the container sections where desired; being user-friendly and easy to use correctly; allowing for multiple re-uses; eliminating unnecessary plastic pieces, and thus providing environmental benefit; holding tightly to prevent bowing of the container walls; being easily retrofitted to existing packaging that would otherwise use plastic clips or staples to assemble the container; being efficient, with no down time required looking for and gathering separate fasteners, such as plastic clips; and reducing costs, with no additional cost being required, since the interlocking clip is formed integral with the container sections, such as one or more corrugated fiberboard cutout sections to be assembled to form the container.

As explained further below, a die-cut tool, forming, for instance, a container fiberboard cutout, may be used to also define the interlocking clips disclosed herein without the need for any separate parts or clips. Further, the interlocking clips disclosed may be easily unlatched, and subsequently snapped back into locking position multiple times without breaking, making the integral clips reusable and durable. Another advantage is that the design disclosed covers any apertures in the container related to the clip function, so that foreign objects, such as dust, dirt, insects, contraband, etc., cannot enter or be readily introduced in transit, or while in storage.

By way of example, the interlocking clip is described further below with reference to a container embodiment used for shipping an electronics rack. However, those skilled in the art will understand that the particular container embodiment described herein is merely one example of a container which may advantageously employ integral interlocking clips, in accordance with one or more aspects of the present invention.

When used with a container, such as a fiberboard container for an electronics rack, a single die-cut tool may be used to define a container section, with the interlocking clips formed, or die-cut, integral with the container section. Thus, only a single die-cut process is needed (in one or more embodiments) to form the container piece and the interlocking clips described. In the example discussed below, two separate, but identical, container sections are die-cut and then assembled using the integral interlocking clips as explained. This approach advantageously eliminates the need for a separate top cap tooling, as in a conventional top cap and container sleeve packaging embodiment. The packaging approach disclosed herein also reduces packaging set up time, and results in less material, while reducing chances of being ripped or torn in transit, as explained below.

By way of example, FIG. 1 is a plan view of one embodiment of a container section 100, such as a die-cut corrugated fiberboard container section, which includes a container sleeve portion 101 with bend lines or bend corners 102, and a top cap portion 103, with bend lines or bend corners 104. Additionally, multiple interlocking clips 110 are defined integral with container section 100. As explained herein, the interlocking clips 110 include tab-receiving apertures, as well as locking tabs formed from, and integral with, the container wall by the die-cut process forming container section 100 as explained.

Prior to describing assembly of a container using two container sections 100, a structural embodiment and use of interlocking clips 110 are described further below with reference to FIGS. 2A-3D.

Figure 2A:
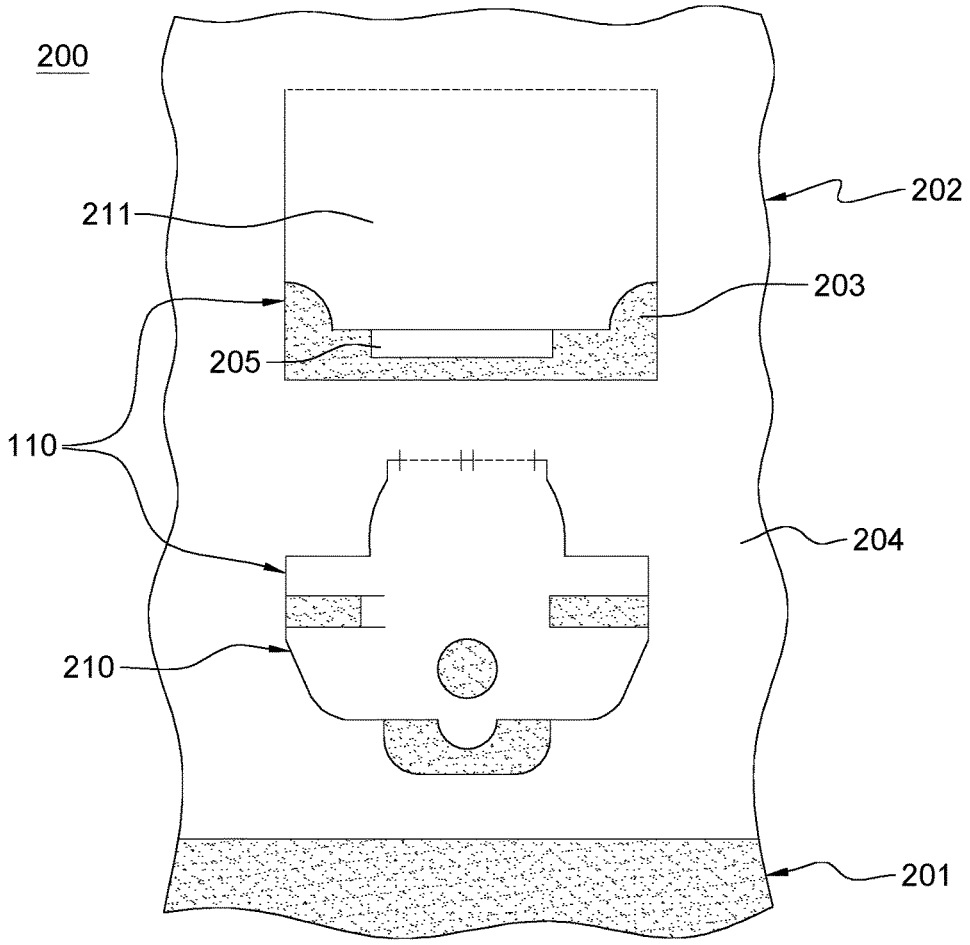
FIG. 2A is an enlarged, partial view of one embodiment of a container with an interlocking clip, in accordance with one or more aspects of the present invention.

FIG. 2A depicts one embodiment of a container 200 formed from one container section 201 and another container section 202, for use in fastening the container sections 201, 202 together. As illustrated in FIG. 2A, interlocking clip 110, in one or more embodiments, includes a tab-receiving aperture 205 through a container wall 203 of the one container section 201, and a locking tab 210 formed from, and integral with, a container wall 204 of the another container section 202. Locking tab 210 is bendable back over its base, where attached to the container wall, to interlock with tab-receiving aperture 205 in the one container section 201, as explained further below.

As depicted in FIG. 2A, interlocking clip 110 may further include a flap 211 formed within other container section 202 so as to overlie, and cover, at least in part, the tab-receiving aperture 205 when the container sections 201, 202 are operatively overlapped for assembly as shown. Flap 211 is bendable to allow for lifting to facilitate interlocking of locking tab 210 with tab-receiving aperture 205, after which flap 211 covers, at least in part, the locking tab operatively inserted within the tab-receiving aperture, as discussed herein.

Figure 2B:
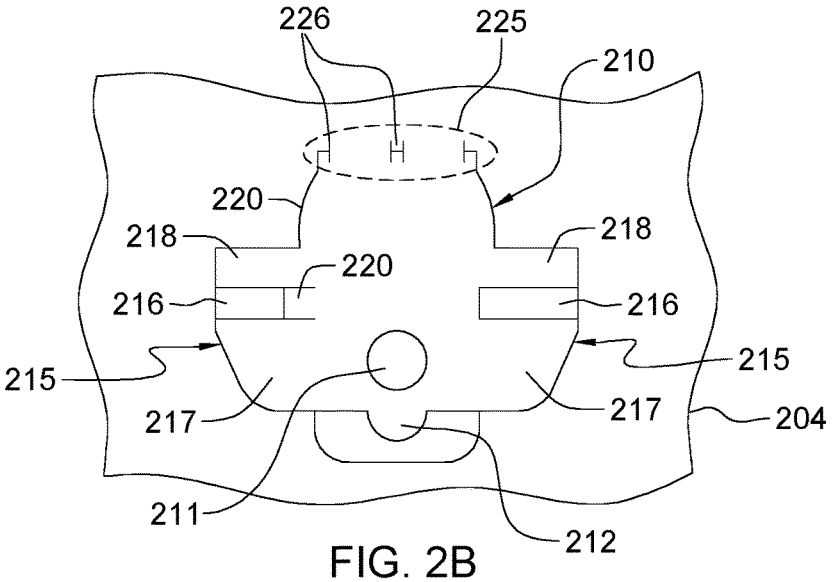
FIG. 2B depicts the locking tab of the interlocking clip of FIG. 2A, in accordance with one or more aspects of the present invention.

FIG. 2B depicts a more detailed view of one embodiment of locking tab 210. As illustrated, locking tab 210 may be defined by a die-cut 220 through container wall 204 of another container section 202 (FIG. 2A), and may include bendable extensions 215 on opposite sides of locking tab 210. Bendable extensions 215 include wall-receiving grooves 216 configured and positioned to receive container wall 203 (FIG. 2A) on opposite sides of tab-receiving aperture 205 (FIG. 2A) when the locking tab 210 is operatively inserted into the tab-receiving aperture to interlock the container sections together. Wall-receiving grooves 216 in bendable extensions 215 result in defining, for each bendable extension 215, an inner-wing portion 217 and an outer-wing portion 218. In one or more implementations, inner-wing portions 217 may be wider than the outer-wing portions 218, for instance, as shown. The inner-wing portions 217 engage, at least in part, an inner surface of the container wall 203 (FIG. 2A) of the one container section 201 (FIG. 2A) when locking tab 210 is operatively inserted within the tab-receiving aperture, and the outer-wing portion 218 engage, at least in part, an outer surface of container wall 203 of one container section 201 (FIG. 2A) when the locking tab 210 is operatively locked within the tab-receiving aperture.

In one or more implementations, locking tab 210 may include a release hole 211, as well as a release hole reinforcement 212 to facilitate, for instance, manually separating or releasing, in part, locking tab 210 from container wall 204 of the container section, as well as manually rotating the locking tab back towards the tab-receiving aperture. Further, release hole 211 may facilitate unlocking of locking tab 210 from the tab-receiving aperture, for instance, to disassemble the container when desired.

In one or more embodiments, locking tab 210 further includes at least one interference portion 220 defined within at least one of the wall-receiving grooves 216 in bendable extensions 215 on opposite sides of locking tab 210. The at least one scored interference portion 220 may be formed, for instance, by leaving extra fiberboard within the groove to engage the container wall and inhibit horizontal and diagonal movement of locking tab 210 when the tab is operatively inserted within the tab-receiving aperture. In one or more implementations, the interference portion may be defined by cuts or partial cuts in the container wall 204 within the at least one wall-receiving groove 216 to facilitate forming the interference fit with the container wall 203 (FIG. 2A) of the container section 201 (FIG. 2A) to facilitate securing the locking tab in fixed position relative to the tab-receiving aperture when the locking tab is operatively locked within the tab-receiving aperture.

In one or more further embodiments, interference portions may be provided within each groove, for instance, at the base of each wall-receiving groove 216, with the extra material being compressed, or pushed up or down, with locking of the locking tab 210 within the tab-receiving aperture.

A hinge region 225 may be defined for locking tab 210 at a base of the locking tab by, for instance, providing multiple partial cutouts 226 in the container wall of the container section to facilitate hinging of the locking tab for interlocking with the tab-receiving aperture. For optimal folding capability, as well as strength and tear resistance, a few, such as two, three, four, etc., partial cuts may be provided within the container wall. Note that as used herein, a partial cut may be a cut in the container wall which does not extend all the way through the container wall. In one or more embodiments, the partial cut may extend part-way through the corrugated fiberboard.

Advantageously, the interlocking clip disclosed herein is integral with or defined within the corrugated packaging that it is cut from, and there is no need to cut out separate interlocking clips. The wings on the opposite sides of the interlocking clip hold the corrugated sections together, and restrict bowing of the corrugated packaging. The interlocking clip disclosed herein can be used anywhere separate plastic clips, or even staples, are used to secure container sections together, at a fraction of the cost.

Figure 3A:
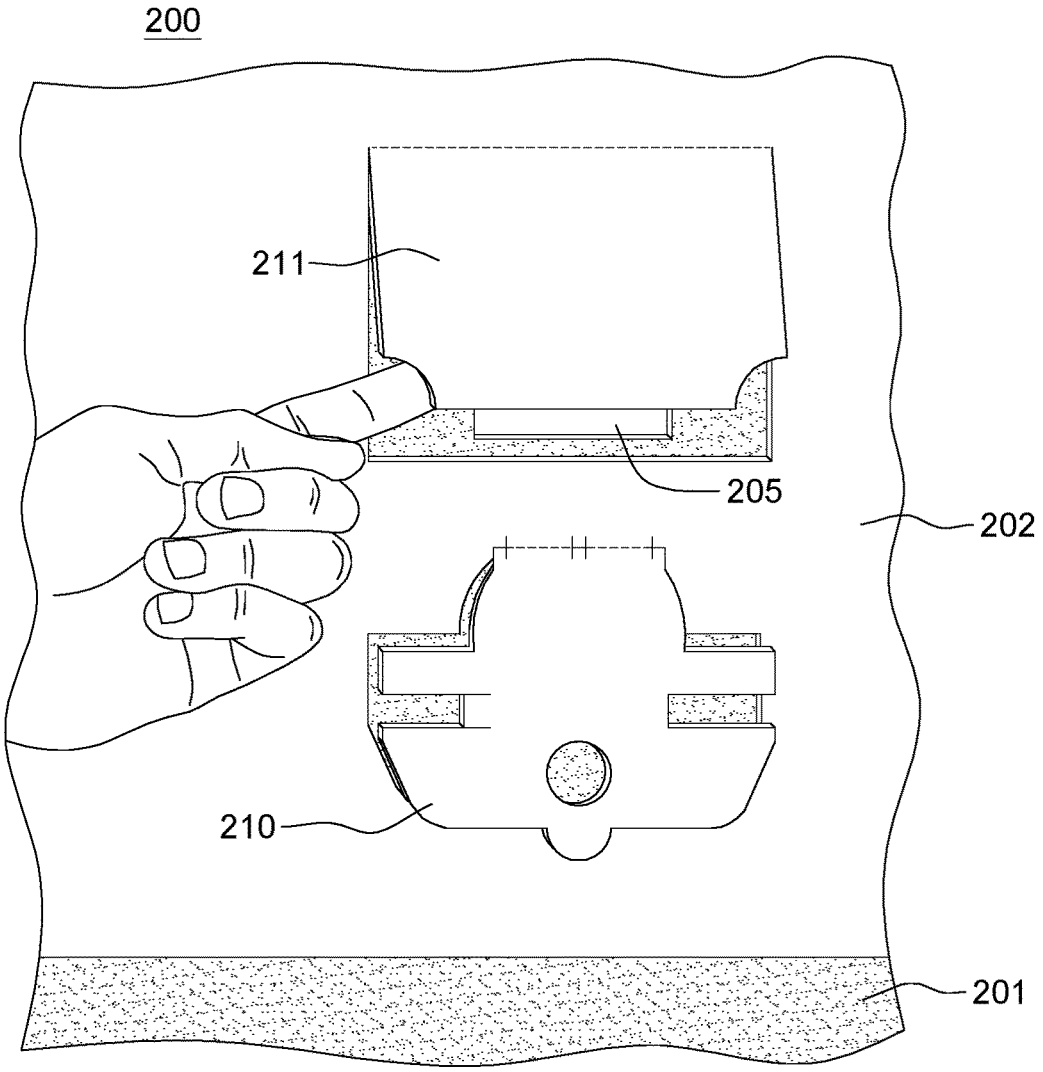
FIGS. 3A-3D depict one embodiment of a process for operatively locking a locking tab and tab-receiving aperture of an interlocking clip in order to fasten together two container sections, in accordance with one or more aspects of the present invention.
Figure 3B:
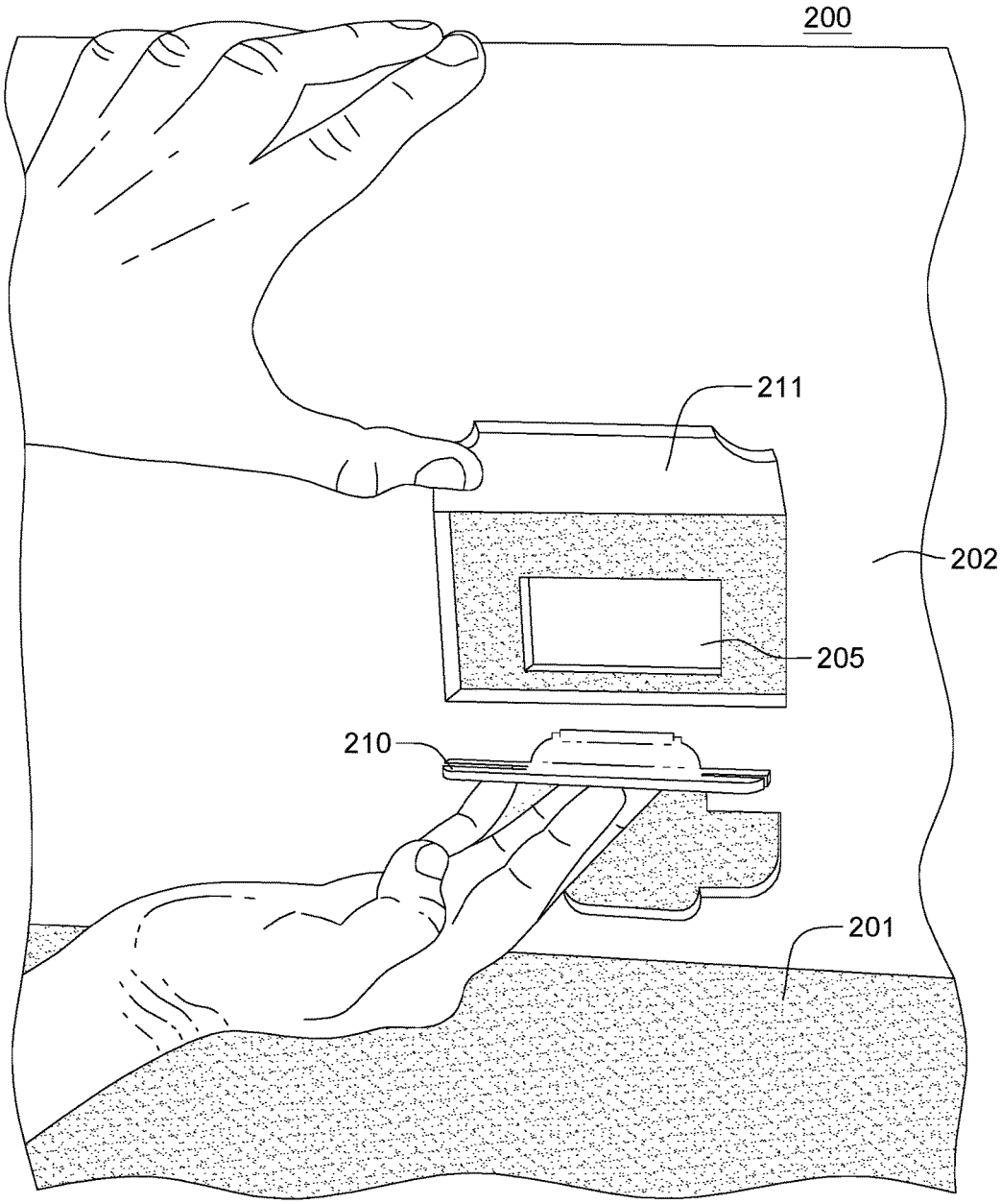

FIGS. 3A-3D depict one embodiment of a process for coupling locking tab 210 and tab-receiving aperture 205 of an interlocking clip 110 together in order to fasten two container sections 201, 202 together in fixed position. FIG. 3A depicts a starting position for the interlocking clip 110 after material has been trimmed or removed, for instance, to define tab-receiving aperture 205, as well as locking tab 210, and flap 211.

Figure 3C:
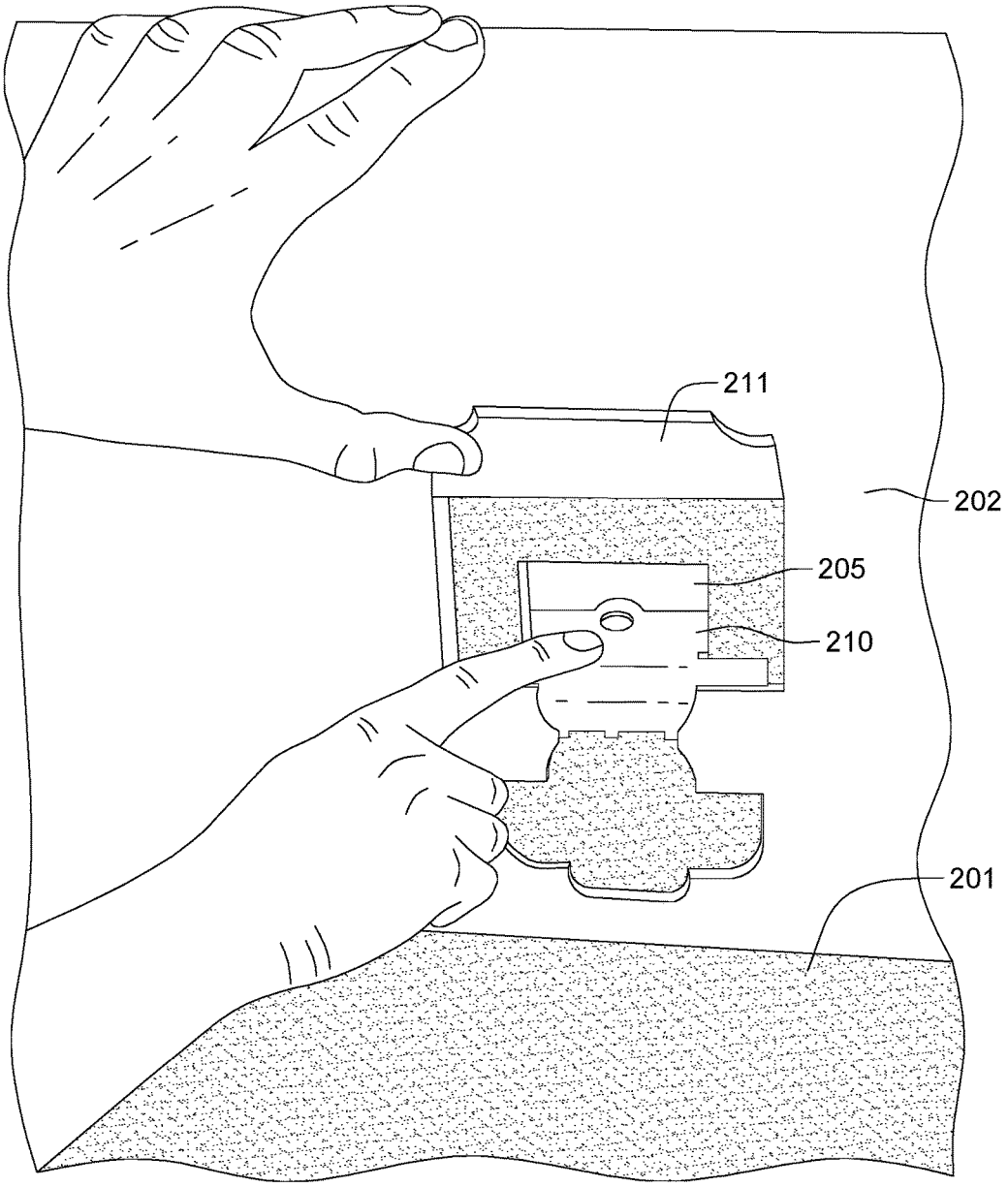
Figure 3D:
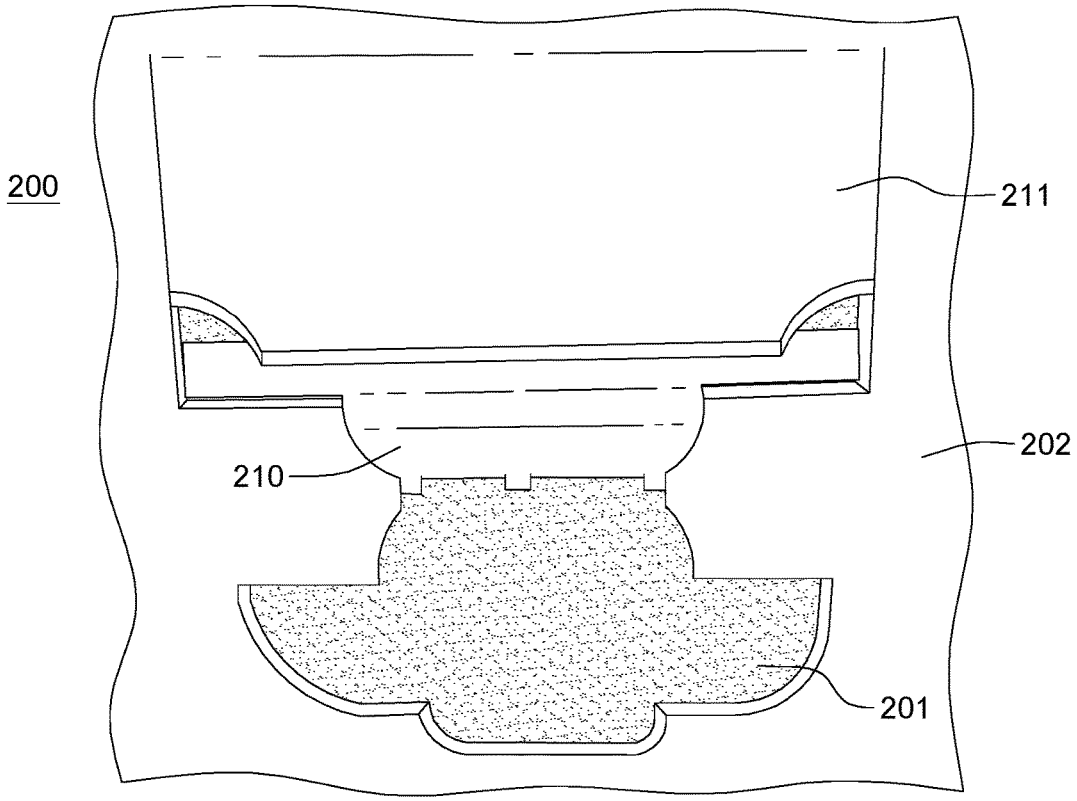

Referring collectively to FIGS. 3A-3D, in use a technician lifts flap 211 to expose tab-receiving aperture 205, and while holding flap 211 open, lifts or pivots locking tab 210 so that the locking tab hinges back over its base for insertion into tab-receiving aperture 205 with the wall-receiving grooves receiving the container wall on opposite sides of the tab-receiving aperture 205 so that the inner-wing portions engage an inner surface of the aperture's container wall, and the outer-wing portions engage an outer surface of the container wall (as illustrated in FIG. 3C). The operative interlocking clip is shown securing container sections 201, 202 together in FIG. 3D.

Advantageously, from the above description, those skilled in the art will understand that the interlocking clip disclosed herein reduces the amount of packaging by being formed integral with the container sections, such as during die-cut. In operation, the locking tab is folded back over itself, into the designed tab-receiving aperture for that tab. There is no need to purchase, retrieve, and assemble, separate clips, or to use staples.

In addition, the design disclosed herein advantageously reduces the number of packaging pieces by removing the need for separate plastic clips. The interlocking clip presented is also visually appealing since, for instance, there is no different colored clips exposed on the packaging. The interlocking clip disclosed advantageously maintains the same integrity and strength as the current plastic clip configuration, and will not break with repeated reuse. Testing has shown that the interlocking clip disclosed may, if desired, be reused over 100 times with no ripping or tearing. With the flap closed over the interlocked locking tab and tab-receiving aperture, contaminants such as dust, debris, etc., are prevented from entering into the container. Use of the interlocking clip is easy and efficient since the clip is integral with the container sections being secured together. The interlocking clip disclosed can be used anywhere that current plastic clips are used to secure container sections together for packaging of, for instance, a computer system, an electronics rack, or any other product package.

FIGS. 4A-4E depict one embodiment of a process for assembling a container 100 for use in shipping, for instance, an electronics rack.

Figure 4A:
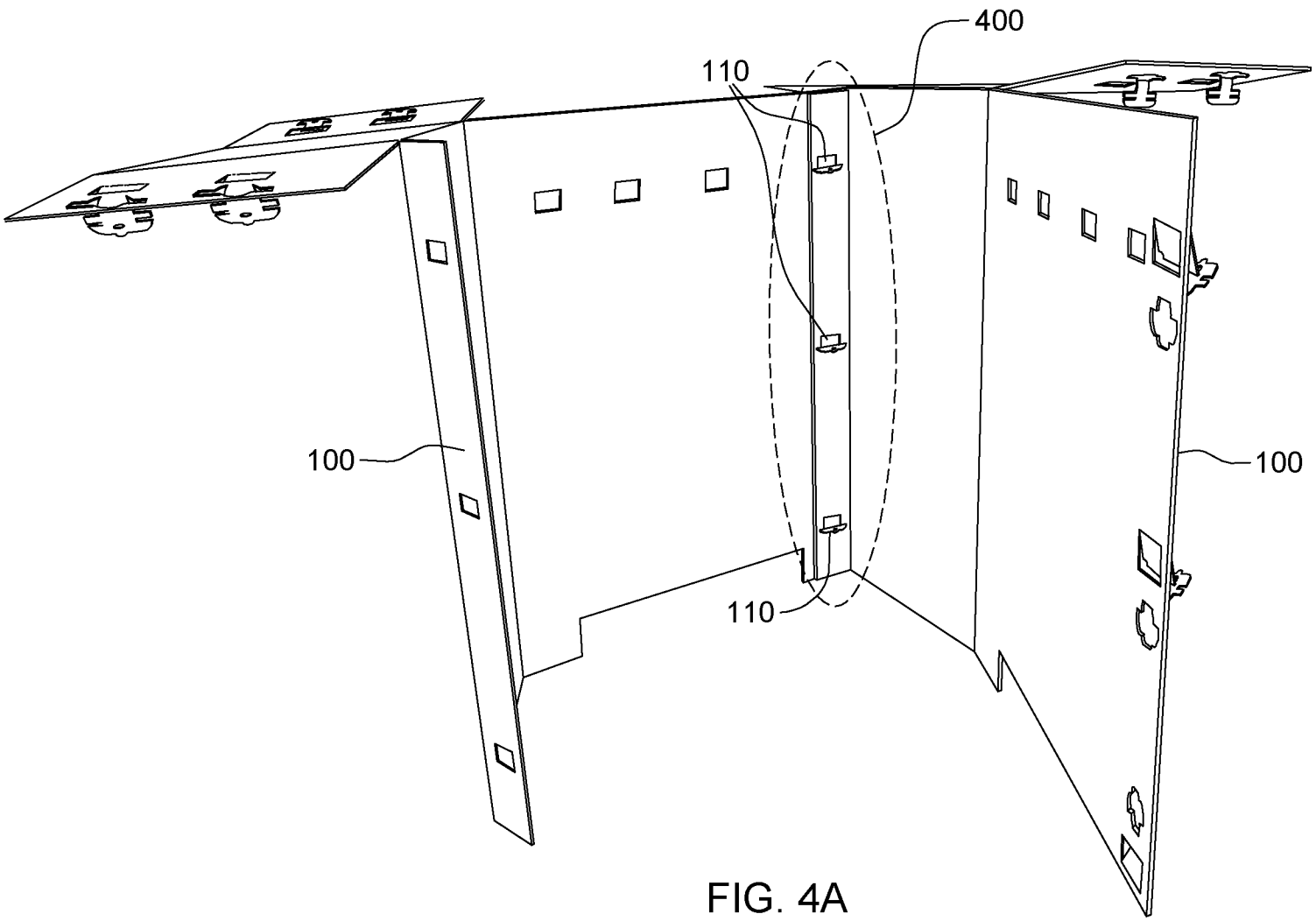
FIG. 4A depicts one embodiment of a container where two container sections are fastened together using interlocking clips, in accordance with one or more aspects of the present invention.

Referring to FIG. 4A, two container sections 100 may be used that are substantially identical. The container sections 100 may be, in one or more implementations, corrugated fiberboard container sections which include, as shown in FIG. 1, container sleeve portion 101, with bend lines or corners 102, and top cap portion 103, with bend lines or corners 104. As illustrated in FIG. 4A, interlocking clips 110 may be used to secure one of the side flaps 400 together, with three interlocking clips 110 being used in the illustrated embodiment, by way of example only.

Figure 4B:
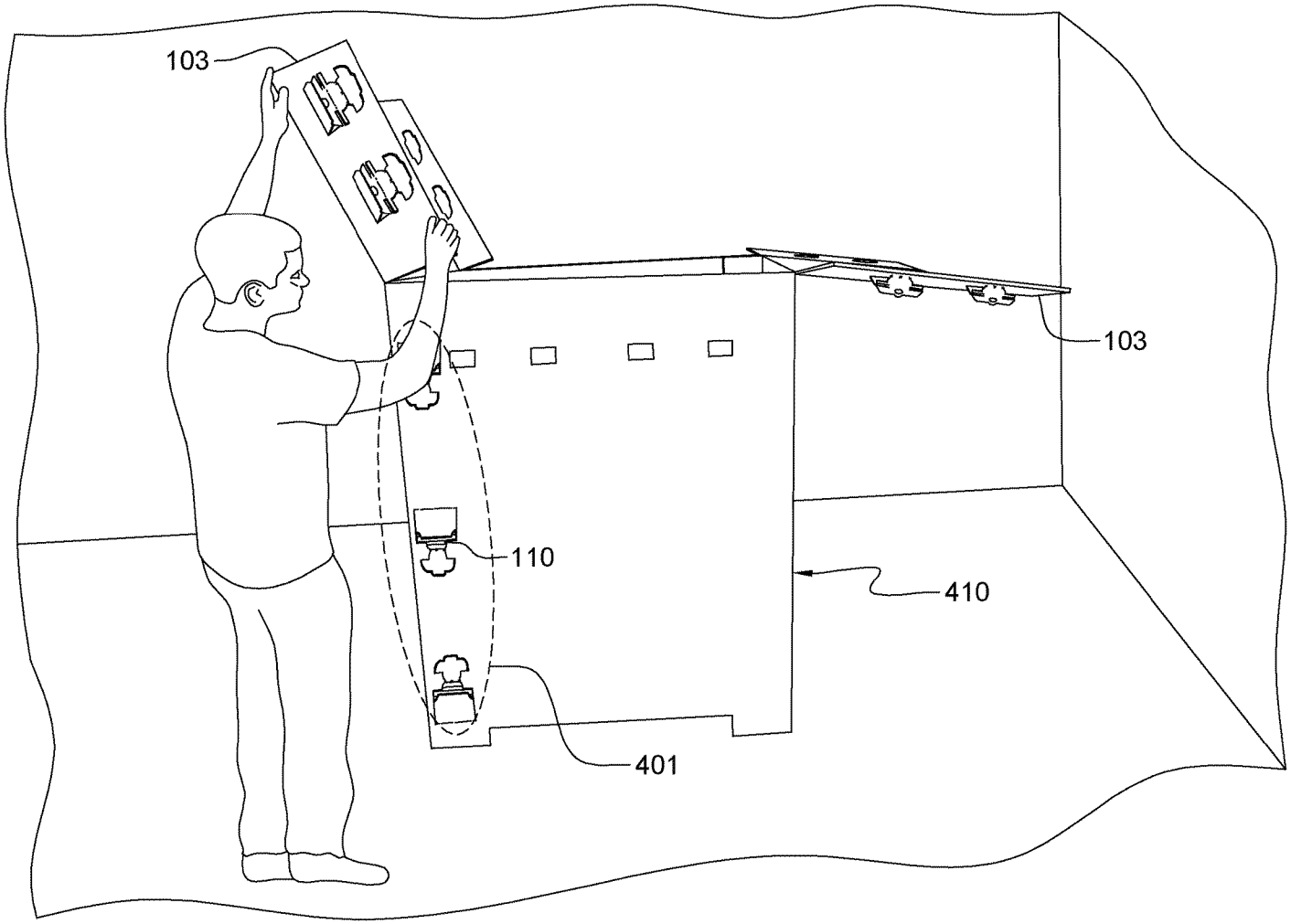
FIG. 4B depicts the assembly of FIG. 4A after formation of a container sleeve of the container by further fastening together additional interlocking clips, in accordance with or more aspects of the present invention.

As illustrated in FIG. 4B, rather than having a separate top cap, the top cap portions 103 hinge to form the top of the container 100. Also shown in FIG. 4B, the container sleeve 410 is completed by securing together the other side flap 401 with multiple interlocking clips 110.

Figure 4C:
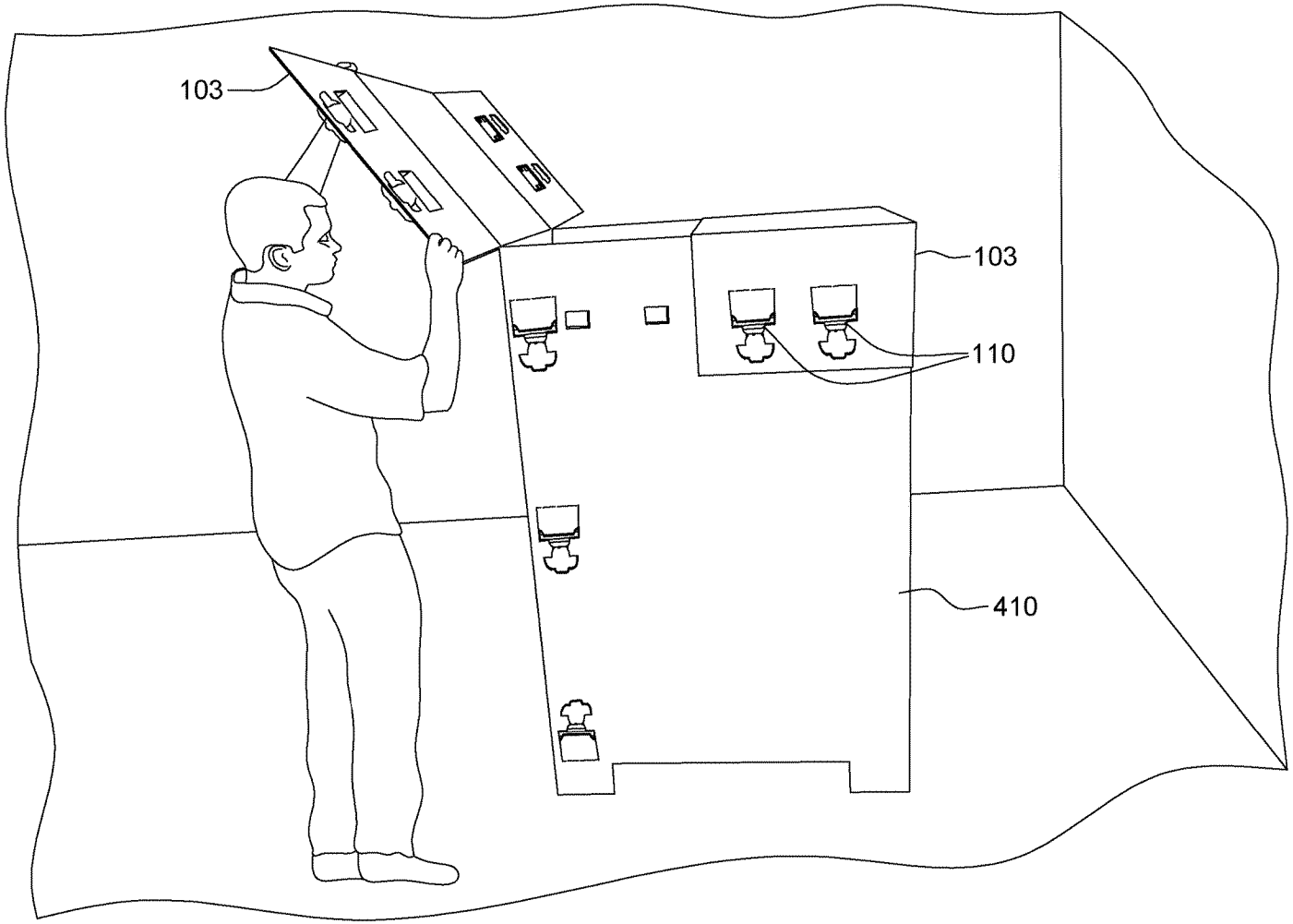
FIG. 4C depicts the assembly of FIG. 4B, with a top cap portion folded over and secured in place to the container sleeve using interlocking clips, in accordance with one or more aspects of the present invention.
Figure 4D:
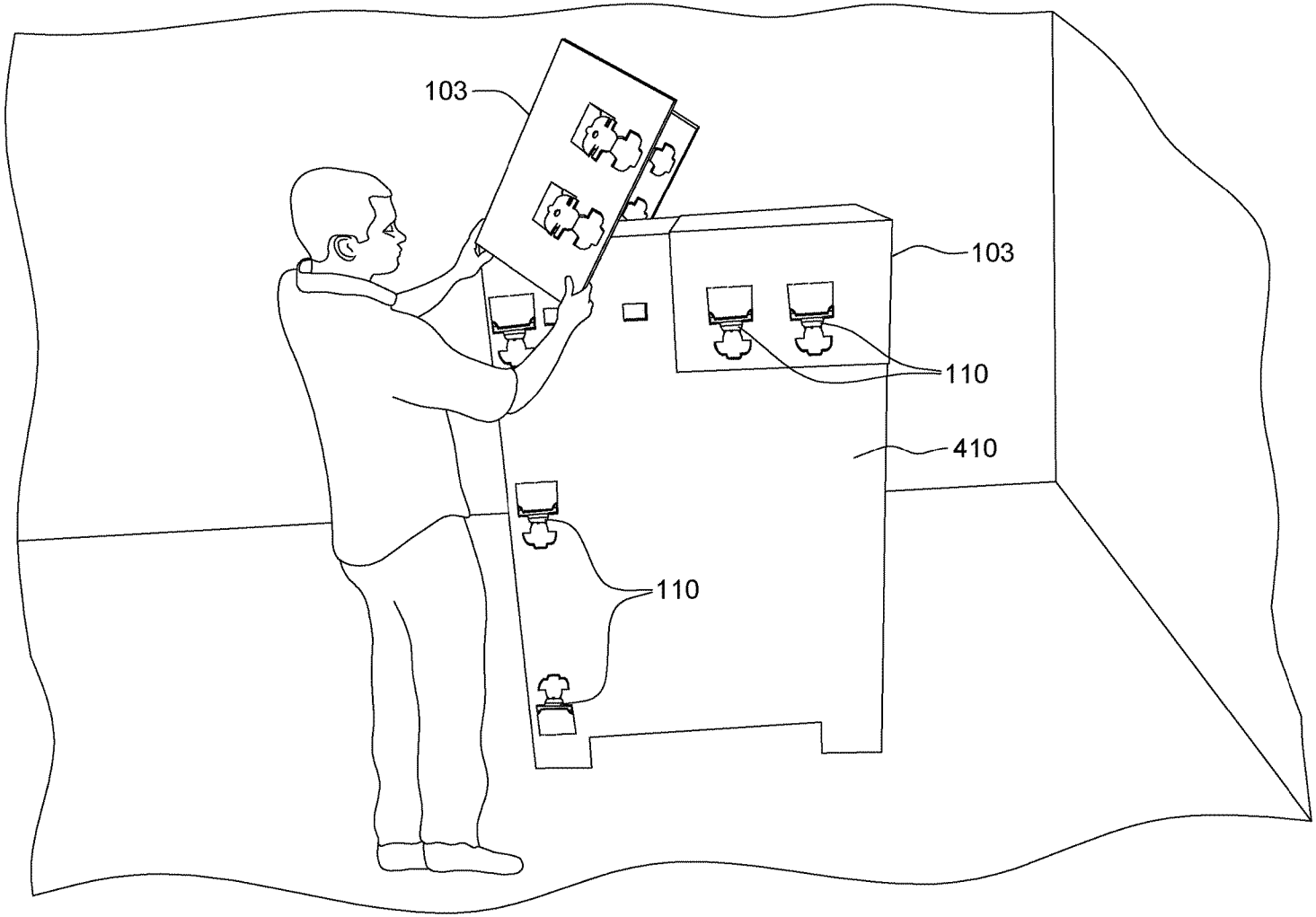
FIG. 4D depicts the assembly of FIG. 4C, with the other top cap portion being folded over for securing in place to the container sleeve using interlocking clips, in accordance with one or more aspects of the present invention.
Figure 4E:
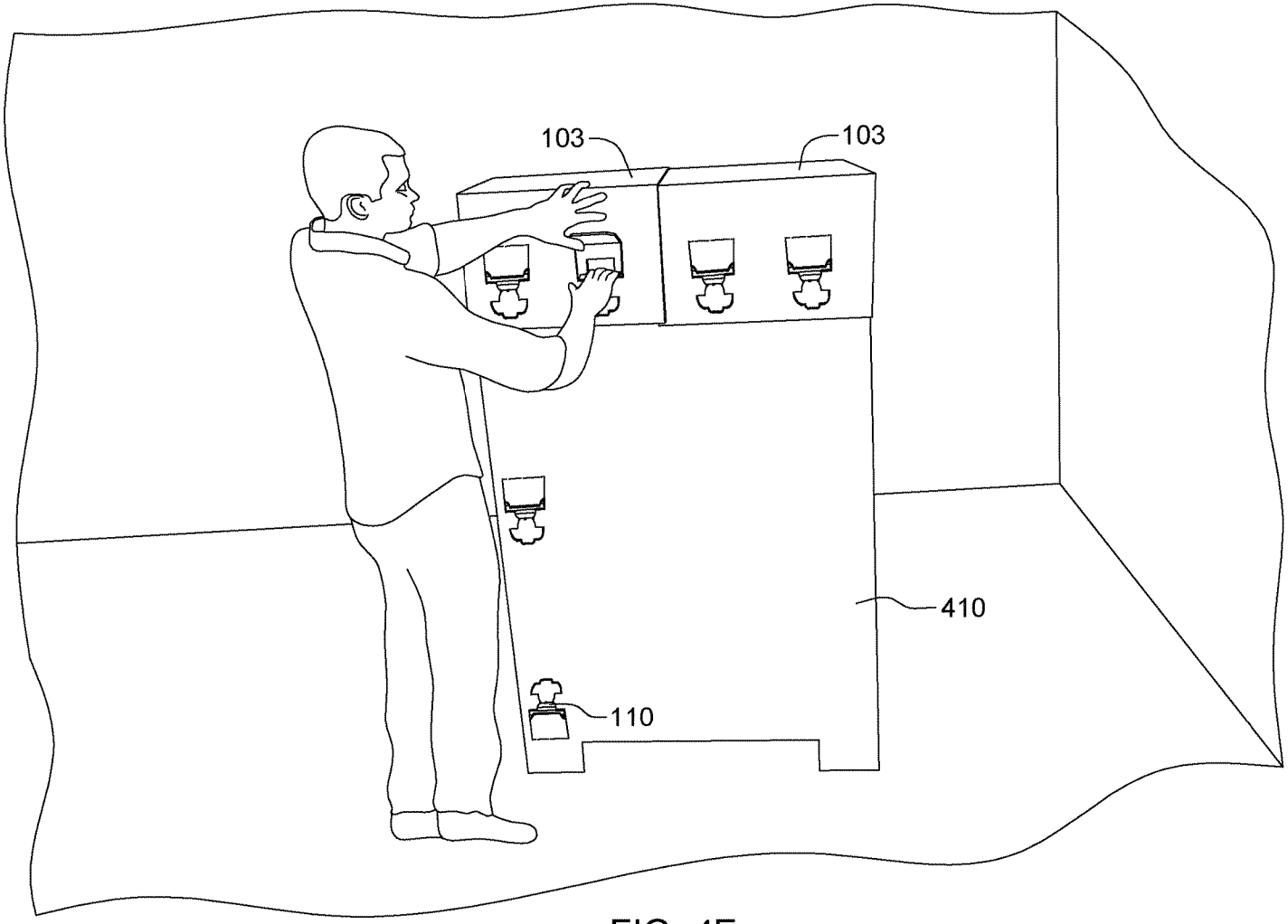
FIG. 4E depicts the assembly of FIG. 4D, with the other top cap portion folded over and being secured in place using the interlocking clips, in accordance with one or more aspects of the present invention.

FIG. 4C illustrates the assembly of FIG. 4B, after one top cap portion 103 has been secured in place using interlocking clips 110, and shows the technician pivoting the other top cap portion 103 in place in FIGS. 4C & 4D for locking in position using respective interlocking clips 110, as illustrated in FIG. 4E.

Figure 4F:
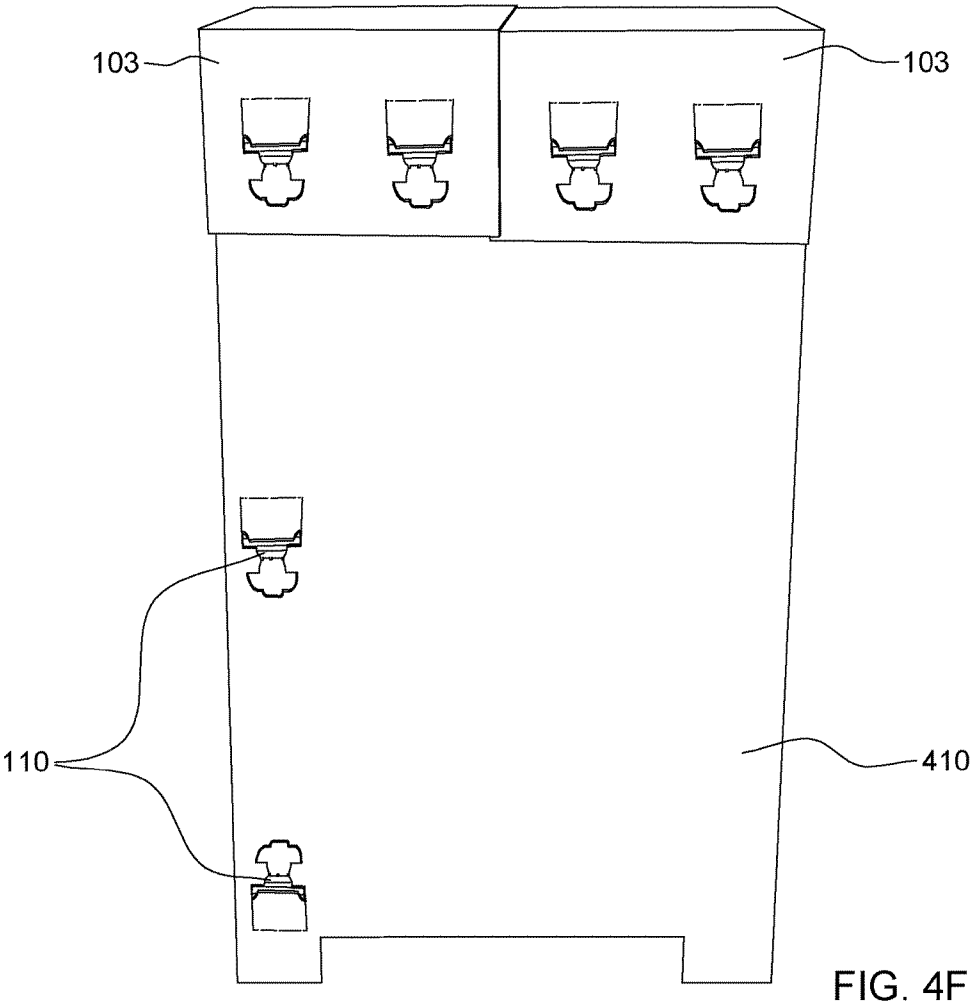
FIG. 4F depicts the assembly of FIG. 4E, with both top cap portions secured in place to the container sleeve using the interlocking clips, in accordance with one or more aspects of the present invention.

As shown in FIG. 4F, top cap portions 103 hinge to flip over and form the top cap, with one portion overlying the other portion, to form a complete seal and prevent any dust or debris from penetrating into the container at the top. In assembly, the technician may begin with either top cap portion being secured using the interlocking clips 110. The end result is a universal design which may be employed with many different types of packaging that simplifies the set up process, as well as the disassembly process, requiring no tools to secure or remove clips or staples to or from the packaging.

Advantageously, with the design presented, there is only need for one part number, for instance, in a quantity of two, in order to assemble the container, with no tools required. Rather than having a separate top cap, the hinged top cap portions are pivoted and latched in order to form the top of the container. The assembly and disassembly process are simple and straightforward, and do not require significant instruction. Further, note that there is no overhang on two of the four sides of the top cap, since (in one or more embodiments) the top cap portions are formed integral with the container sleeve portions. This facilitates shipping by allowing for slidable placement of one package relative to another, without having any material extending past the opposite container sleeve sides which could rip or tear. In addition to reducing the amount of parts required, the design presented advantageously eliminates the need for any top cap tooling to separately form a top cap structure, and reduces packaging set up time. Further, only one die-cut is needed to form the container sections and the interlocking clips.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. A fastener comprising:

an interlocking clip formed integral with one container section and another container section for fastening the container sections together, the one container section and the another container section being overlapping container sections, and the interlocking clip comprising:

a tab-receiving aperture through a container wall of the one container section; and a locking tab formed from, and integral with, a container wall of the another container section, the locking tab being bendable to interlock with the tab-receiving aperture in the one container section, and the locking tab comprising:

bendable extensions on opposite sides of the locking tab, the bendable extensions comprising wall-receiving grooves to receive the container wall on opposite sides of the tab-receiving aperture in the one container section when the locking tab is operatively inserted into the tab-receiving aperture to interlock the container sections together.

2. The fastener of claim 1, wherein the another container section overlies the one container section.

3. The fastener of claim 2, wherein the container sections are corrugated fiberboard container sections.

4. The fastener of claim 1, wherein the interlocking clip further includes a flap formed integral with the another container section to overlie and cover, at least in part, the tab-receiving aperture through the container wall of the one container section, the flap being bendable to allow interlocking of the locking tab of the another container section with the tab-receiving aperture in the one container section, and the flap covering, at least in part, the locking tab operatively inserted within the tab-receiving aperture.

5. The fastener of claim 4, wherein the flap formed integral with the another container section is larger than the tab-receiving aperture through the container wall of the one container section.

6. The fastener of claim 1, wherein the tab further includes at least one scored interference portion defined within at least one of the wall-receiving grooves in the bendable extensions on the opposite sides of the locking tab, the at least one scored interference portion forming an interference fit with the container wall of the one container section adjacent to the tab-receiving aperture to facilitate securing the locking tab in fixed position relative to the tab-receiving aperture when the locking tab is operatively inserted within the tab-receiving aperture.

7. The fastener of claim 1, wherein the interlocking clip further includes multiple partial cutouts in the another container section at a base of the locking tab to facilitate hinging of the locking tab back over the base of the locking tab for interlocking of the locking tab with the tab-receiving aperture in the container wall of the one container section.

8. The fastener of claim 1, wherein the wall-receiving grooves in the bendable extensions of the locking tab define, for each bendable extension, an inner-wing portion and an outer-wing portion, the inner-wing portions engaging, at least in part, an inner surface of the container wall of the one container section when the locking tab is operatively locked within the tab-receiving aperture, and the outer-wing portions engaging, at least in part, an outer surface of the container wall of the one container section when the locking tab is operatively locked within the tab-receiving aperture.

9. The fastener of claim 1, wherein the locking tab further comprises a release hole in the locking tab for facilitating manually releasing, in part, the locking tab from the container wall of the another container section, and manually rotating the locking tab towards the tab-receiving aperture.

10. A container comprising:

a first container section;

a second container section; and multiple interlocking clips formed integral with the first and second container sections for fastening the first and second container sections together, the first and second container sections being overlapping container sections, and at least one interlocking clip of the multiple interlocking clips comprising:

a tab-receiving aperture through a container wall of one of the first and second container sections; and a locking tab formed from, and integral with, a container wall of the other of the first and second container sections, the locking tab being bendable to interlock with the tab-receiving aperture, and the locking tab comprising:

bendable extensions on opposite sides of the locking tab, the bendable extensions comprising wall-receiving grooves to receive the container wall on opposite sides of the tab-receiving aperture when the locking tab is operatively inserted into the tab-receiving aperture to interlock the container sections together.

11. The container of claim 10, wherein the second container section overlies the first container section.

12. The container of claim 11, wherein the first and second container sections are corrugated fiberboard container sections.

13. The container of claim 12, wherein the first and the second container sections are part of a common fiberboard cutout foldable to form, at least in part, the container.

14. The container of claim 12, wherein the first and second container sections are part of different fiberboard cutouts assemblable to form, at least in part, the container.

15. The container of claim 10, wherein the at least one interlocking clip further includes a flap formed integral with the other of the first and the second container sections to overlie and cover, at least in part, the tab-receiving aperture, the flap being bendable to allow interlocking of the locking tab with the tab-receiving aperture, and the flap covering, at least in part, the locking tab operatively inserted within the tab-receiving aperture.

16. The container of claim 10, wherein the locking tab further comprises at least one scored interference portion defined within at least one of the wall-receiving grooves on the opposite sides of the locking tab, the at least one scored interference portion forming an interference fit with the container wall adjacent to the tab-receiving aperture to facilitate securing the locking tab in fixed position relative to the tab-receiving aperture when the locking tab is operatively inserted within the tab-receiving aperture.

17. The container of claim 10, wherein the other of the first and second container sections includes multiple partial cutouts at a base of the locking tab to facilitate hinging of the locking tab back over the base of the locking tab for interlocking the locking tab with the tab-receiving aperture.

18. The container of claim 10, wherein the wall-receiving grooves in the bendable extensions of the locking tab define, for each bendable extension, an inner-wing portion and an outer-wing portion, the inner-wing portions engaging, at least in part, an inner surface of the container wall of the one of the first and second container sections when the locking tab is operatively locked within the tab-receiving aperture, and the outer-wing portions engaging, at least in part, an outer surface of the container wall of the one of the first and second container sections when the locking tab is operatively locked within the tab-receiving aperture.

19. The container of claim 10, wherein the locking tab further comprises a release hole in the locking tab for facilitating manually releasing, in part, the locking tab from the container wall of the other of the first and second container sections, and manually rotating the locking tab towards the tab-receiving aperture.

20. A method comprising:

forming an interlocking clip integral with one container section and another container section for fastening the container sections together, the one container section and the another container section being overlapping container sections, and the forming comprising:

providing a tab-receiving aperture through a container wall of the one container section; and providing a locking tab formed from, and integral with, a container wall of the another container section, the locking tab being bendable to interlock with the tab-receiving aperture in the one container section, and the locking tab comprising:

bendable extensions on opposite sides of the locking tab, the bendable extensions comprising wall-receiving grooves to receive the container wall on opposite sides of the tab-receiving aperture in the one container section when the locking tab is operatively inserted into the tab-receiving aperture to interlock the container sections together.

* * * * *